US007530936B1

(12) United States Patent
Hall

(10) Patent No.: US 7,530,936 B1
(45) Date of Patent: May 12, 2009

(54) EXERCISE MACHINE

(76) Inventor: Antony A. Hall, 5506 Mainsgate Rd., Wichita, KS (US) 67220

( * ) Notice: Subject to any disclaimer, the term of this patent is extended or adjusted under 35 U.S.C. 154(b) by 0 days.

(21) Appl. No.: 11/608,659

(22) Filed: Dec. 8, 2006

(51) Int. Cl.
*A63B 26/00* (2006.01)

(52) U.S. Cl. ..... 482/142; 482/56; 482/72; 482/93; 482/137

(58) Field of Classification Search ..... 482/142, 482/55, 56, 91, 93, 133–135, 138, 145, 72–73, 482/97, 139, 96, 137; 601/24, 33
See application file for complete search history.

(56) References Cited

U.S. PATENT DOCUMENTS

| | | | | | |
|---|---|---|---|---|---|
| 326,247 | A | * | 9/1885 | Root | 482/56 |
| 1,176,365 | A | * | 3/1916 | Hartnett | 482/56 |
| 2,109,775 | A | | 3/1938 | Hudson | |
| 2,855,199 | A | * | 10/1958 | Noland et al. | 482/97 |
| 3,810,614 | A | | 5/1974 | Hesburg | |
| 3,892,404 | A | | 7/1975 | Martucci | |
| 4,344,619 | A | * | 8/1982 | Szabo | 482/97 |
| 4,422,634 | A | | 12/1983 | Hopkins | |
| 4,502,681 | A | * | 3/1985 | Blomqvist | 482/130 |
| 4,674,160 | A | * | 6/1987 | Gibson | 482/97 |
| 4,674,740 | A | | 6/1987 | Iams et al. | |
| 4,798,378 | A | | 1/1989 | Jones | |
| 4,830,363 | A | * | 5/1989 | Kennedy | 482/56 |
| 4,844,450 | A | | 7/1989 | Rodgers, Jr. | |
| 4,854,578 | A | * | 8/1989 | Fulks | 482/100 |
| 5,066,003 | A | * | 11/1991 | Jones | 482/137 |
| 5,098,361 | A | * | 3/1992 | Danylieko | 482/97 |
| 5,135,449 | A | * | 8/1992 | Jones | 482/72 |
| 5,282,748 | A | * | 2/1994 | Little | 434/254 |
| 5,310,393 | A | * | 5/1994 | Highsmith et al. | 482/93 |
| 5,779,600 | A | | 7/1998 | Pape | |
| 5,788,614 | A | * | 8/1998 | Simonson | 482/97 |
| 6,120,425 | A | | 9/2000 | Endelman | |
| 6,179,757 | B1 | * | 1/2001 | Koenig | 482/97 |
| 6,352,493 | B1 | | 3/2002 | Davis | |
| 6,387,024 | B1 | * | 5/2002 | Monti et al. | 482/142 |
| 6,471,624 | B1 | * | 10/2002 | Voris | 482/142 |
| 6,645,130 | B2 | * | 11/2003 | Webber | 482/142 |
| 6,764,431 | B2 | | 7/2004 | Yoss | |
| 6,860,840 | B2 | * | 3/2005 | Carter | 482/97 |
| 6,932,749 | B2 | * | 8/2005 | Barnes et al. | 482/142 |

(Continued)

*Primary Examiner*—Fenn C Mathew
*Assistant Examiner*—Andrew M Tecco
(74) *Attorney, Agent, or Firm*—Kenneth H. Jack; Davis & Jack, L.L.C.

(57) ABSTRACT

An exercise machine having a bench top having a right side, a left side, a forward end, a rearward end, and having an upper support surface; the exercise machine further having a rear leg fixedly attached to and extending downwardly from the bench top's rearward end; the exercise machine further having a "J" leg having a stem section and a tail section, the "J" leg's stem section having an upper end fixedly attached to the bench top's forward end, the "J" leg's tail section having a distal end; the exercise machine further having at least a first arm, the at least first arm having a proximal end and a distal end, the proximal end of the at least first arm being pivotally attached to the distal end of the "J" leg's tail section; the exercise machine further having a first handle fixedly attached to the at least first arm's distal end; and the exercise machine further having a first free weight bar fixedly attached to the at least first arm's distal end.

9 Claims, 3 Drawing Sheets

U.S. PATENT DOCUMENTS 6,991,589 B1 1/2006 Patterson
7,060,014 B2 * 6/2006 Bergman et al. ..... 482/141
2003/0134723 A1 * 7/2003 Greenland ..... 482/104

* cited by examiner

EXERCISE MACHINE

FIELD OF THE INVENTION

This invention relates to machinery adapted for facilitating and assisting in personal exercise and muscle development. More particularly, this invention relates to such machinery which is specially adapted for exercising arm and shoulder muscles.

BACKGROUND OF THE INVENTION

Rowing type exercise machines for exercising a user's deltoid, trapezius, and teres major shoulder and back muscles, and for exercising the user's brachialls, biceps brachii, and brachiordialis arm muscles are known. Such rowing machines typically provide a support platform and a sitting surface for supporting an exerciser in a sitting or partially supine or recumbent position. In such position, the exerciser may repeatedly and reciprocatingly manually pull upon a handle in the manner of a rower of a boat or racing shell. Such rowing style pulling exercise typically additionally exercises back, leg, and hip muscles. Where users of such exercise machines desire to isolate and concentrate exercise of musculature at the above referenced shoulder and arm muscles, such rowing style of exercise may be undesirable.

The instant inventive exercise machine solves or ameliorates problems noted above by providing a bench style exercise machine upon which a user may exercise while lying face down or prone and while pulling upwardly against underlying weight bearing or pivot resisting pivot arms.

BRIEF SUMMARY OF THE INVENTION

A first structural component of the instant inventive exercise machine comprises a bench top having a right side, a left side, a forward end, a rearward end, and having an upper exerciser support surface. Preferably, the bench top comprises an oblong plate of plywood or durable composite board, such plate having a sheet of foam rubber cushioning disposed over its upper surface, and such cushioning being outwardly protected by a thin sheet of durable vinyl. Preferably, such sheets of foam rubber cushioning, and durable vinyl are applied to the upper surface of the bench top board in the manner of cushioned upholstery. In the preferred embodiment of the instant invention, a longitudinally extending steel beam stiffening member extends along and supports the under surface of the bench top, the front and rear ends of such stiffening member serving to rigidly interconnect upper ends of legs which extend downwardly from the under surface of the bench top, as is more fully described below.

A further structural component of the instant inventive exercise machine comprises a rear leg which is fixedly attached to and which extends downwardly from the rearward end of the bench top. Preferably, the rear leg is configured in the form of an inverted "T", the stem portion of the "T" forming a leg or column for supporting the rearward end of the bench top, and the left and right arms of the "T" serving as lateral stabilizing members. Also, in the preferred embodiment of the instant invention, the left and right arms of such "T" configured leg are canted angularly rearward for enhancing the longitudinal stability of the exercise machine.

A further structural component of the instant inventive exercise machine comprises a "J" leg having a stem section and a tail section, the "J" leg's stem section having an upper end fixedly attached to the bench top's forward end, and the "J" leg's tail section having a distal end. Just as the inverted "T" configured rear leg includes left and right arm extensions, the tail section of the inventive machine's front "J" leg preferably forms right and left extensions, such extensions multiply functioning to provide lateral stability to the front end of the exercise machine, and to provide convenient structural attachment points for pivotal support of the machine's pivot arm or arms, as is more fully discussed below.

A further structural component of the instant inventive exercise machine comprises at least a first, and preferably right and left pivot arms, each such arm having a proximal end and a distal end. In the preferred embodiment, the proximal end of each pivot arm is pivotally attached to the distal end of the "J" leg's tail section. Where the "J" leg's tail section includes the preferred right and left extensions, and where both first and second pivot arms are provided, the pivotal attachments of such arms are preferably respectively located at right and left ends of such extensions.

A further structural component of the instant inventive exercise machine comprises at least a first pull handle which is preferably fixedly attached to the distal end of the at least first arm. Where, as preferred, first and second pivot arms are provided, first and second pull handles are likewise provided, such handles being respectively fixedly attached to the distal ends of such arms.

A further component of the instant inventive exercise machine comprises pivot resisting means, such means at least being connected operatively to the machine's at least first arm. Where preferred left and right pivot arms and handles are provided, the pivot resisting means preferably is operatively connected to both arms.

In operation of the instant inventive exercise machine, an exerciser may lie prone or face down and head forward upon the upper support surface of the bench top. Thereafter, the exerciser may extend one of his or her arms downwardly to grasp the pull handle attached to the at least first pivot arm. Thereafter, the exerciser may repeatedly pull upwardly thereon. Upon imposition of such pulling action, the pivot resisting means advantageously applies a counter-torque moment which resists such pulling motion and exercises the exerciser's arm. Where the inventive machine includes, as preferred, both left and right "J" leg tail section extensions, left and right pivot arms, and left and right pull handles, both of the exerciser's arms may be extended downwardly for simultaneous left and right arm and shoulder muscle exercise.

In the preferred embodiment of the instant inventive exercise machine, the pivot resisting means comprises at least a first and preferably a pair of free weight supporting bars which are rigidly and fixedly attached to the distal ends of the machine's preferably paired pivot arms. Suitably, the pivot resisting means may alternately comprise spring means connected operatively to the pivot arms for resisting upward pulling forces applied to such arms. Also suitably, the pivot resisting means may alternately comprise an incorporation of friction plates into the pivot arms' pivot joints.

Accordingly, objects of the instant invention include the provision of an exercise machine which incorporates a forward "J" leg wherein such "J" leg includes a tail section which is adapted for multiply functioning as a stabilizing member and as a pivot arm support structure.

Other and further objects, benefits, and advantages of the present invention have been discussed above and will become known to those skilled in the art upon review of the Detailed Description of a Preferred Embodiment which follows, and upon review of the appended drawings.

DETAILED DESCRIPTION OF A PREFERRED EMBODIMENT

Figure 1:
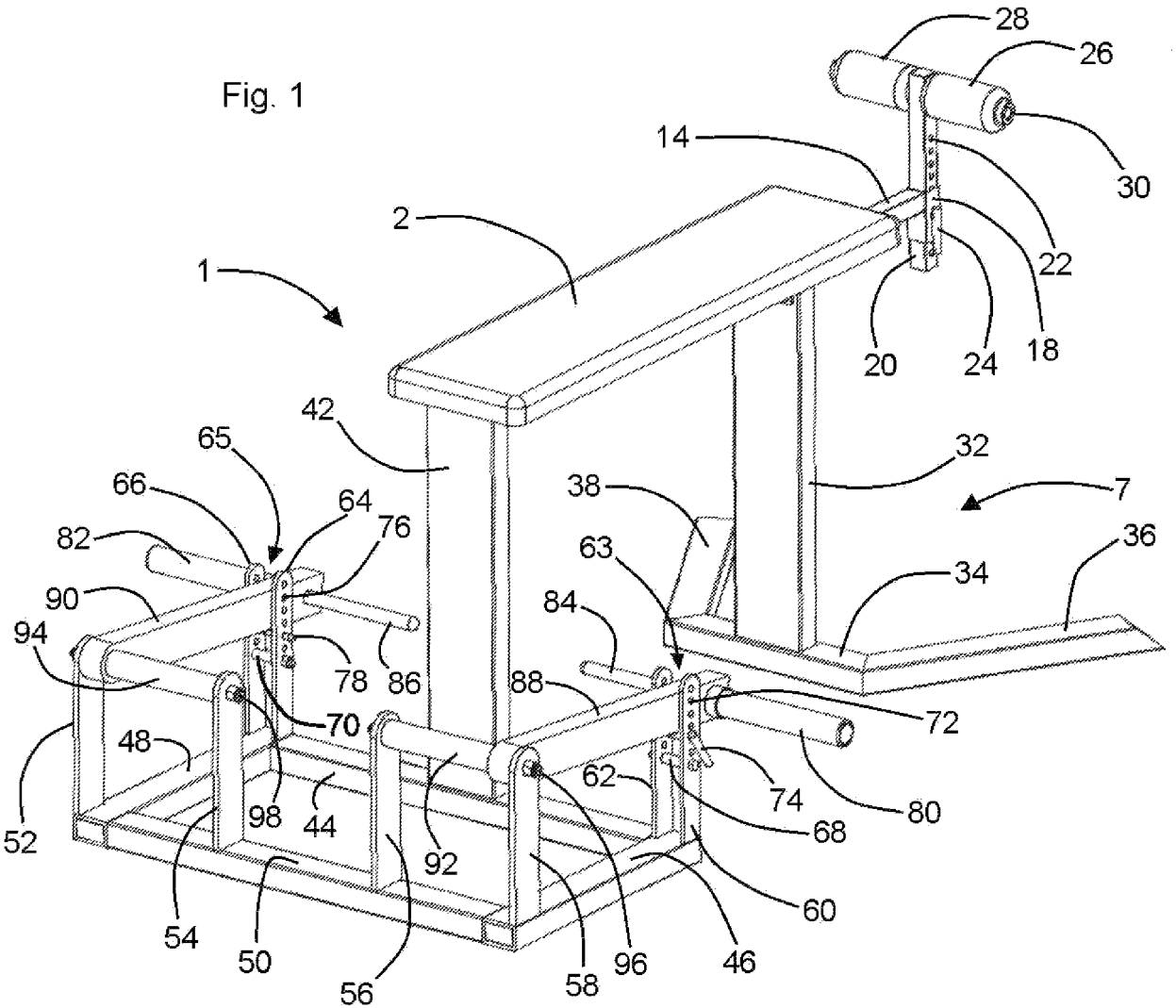
FIG. 1 is an isometric view of a preferred embodiment of the instant inventive exercise machine.
Figure 3:
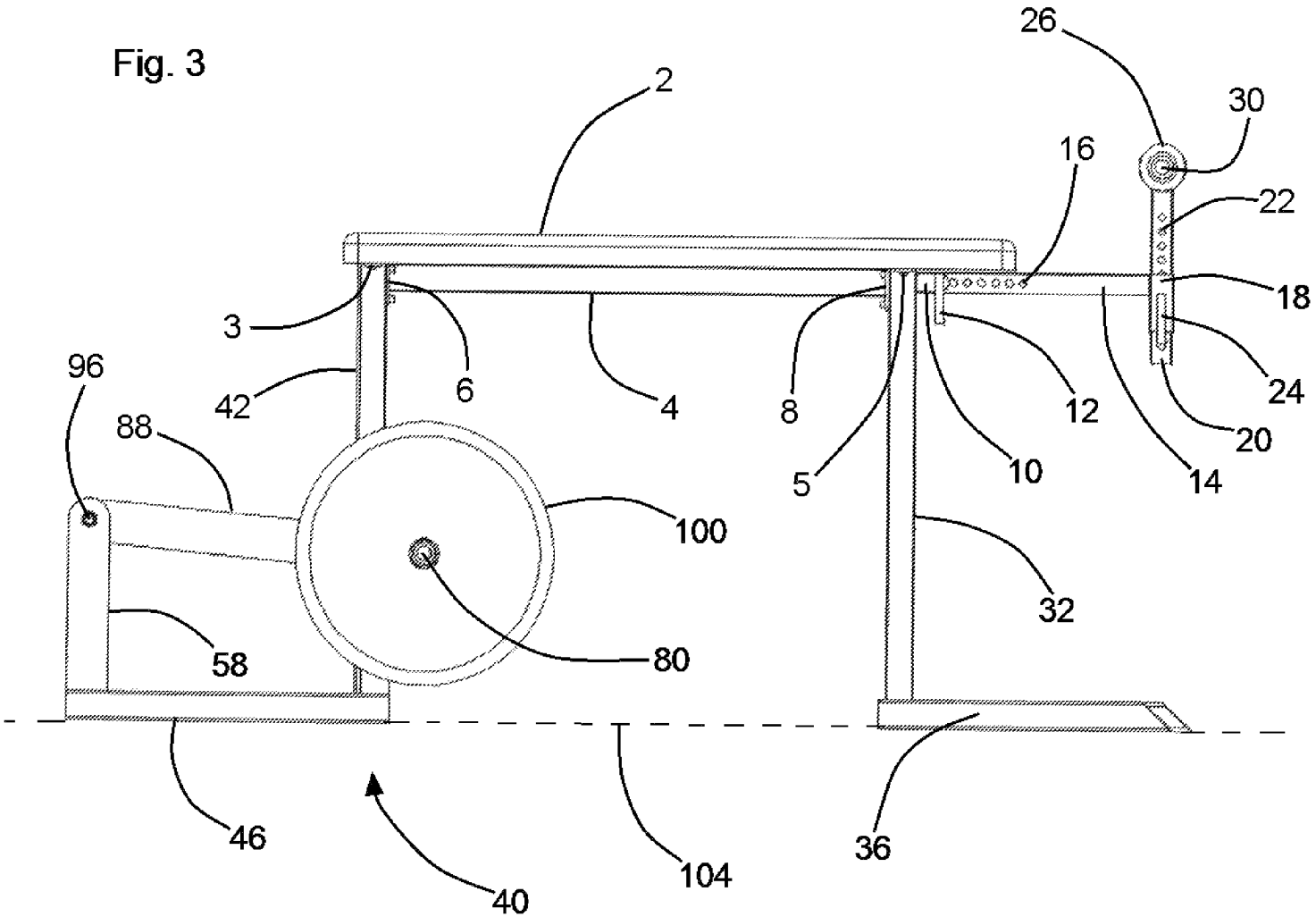
FIG. 3 is a side elevation of the machine of FIG. 2.

Referring now to the drawings, and in particular to FIG. 1, a preferred embodiment of the instant inventive exercise machine is referred to generally by Reference Arrow 1. The exercise machine 1 preferably comprises a cushioned bench top 2. Referring further simultaneously to FIG. 3, the under surface of the bench top 2 is preferably rigidly supported by an underlying support beam 4, such beam having front and rear mounting flanges 6 and 8 fixedly welded thereto. Preferably, the support beam 4 comprises a length of steel square tubing which extends rearwardly beyond mounting flange 8 to seamlessly present a rearwardly opening extension 10. The extreme rearward end of the square tubing support beam 4 preferably receives, in the manner of a quill and shaft combination, a smaller gauge length of steel square tubing 14, such tube 14 functioning as a an adjustable heel catch extension shaft. Preferably, the heel catch extension shaft 14 includes a plurality of laterally extending position adjustment apertures 16 which may selectively engage a removable "L" pin 12, such bin being extendable through a pair of laterally extending eyes which extend through the rearwardly extending section 10 of the support beam 4.

Referring further simultaneously to FIGS. 1 and 3, second quill and slide shaft combination is preferably fixedly welded to the distal or extreme rearward end of heel catch extension shaft 14, such second combination preferably comprising a vertically opening slide sleeve 18 which receives a vertical height adjustment slide shaft 20. Similarly, with the heel catch extension shaft 14, adjustment apertures 22 extend laterally through shaft 20 for selective engagement with a second "L" pin 24. Heel catching "T" cushions 26 and 28 are preferably fixedly mounted to the upper end of slide the vertical height adjustment shaft 20 by means of a laterally extending "T" bar 30. By selectively slidably moving shafts 14 and 20 within their slide sleeves 4 and 18, and by manipulating the "L" pins 12 and 24 slidably into and out of locking engagements with adjustment apertures 16 and 22, an exerciser utilizing the inventive exercise machine may correctly and comfortably position the heel catching cushions 26 and 28.

Referring further simultaneously to FIGS. 1 and 3, the instant inventive exercise machine 1 preferably further comprises a rear leg which is designated generally by Reference Arrow 7. The rear leg 7 preferably comprises a vertically extending support column which preferably comprises a length of rectangular steel tubing 32. The upper end of the rectangular tube 32 is preferably notched in order to allow rearward passage of the square tube beam 4, and the rearward mounting plate 8 of such beam is preferably rigidly bolted to the forward face of the rectangular tube 32. Additionally, a laterally extending mounting plate 5 is preferably fixedly welded to the extreme upper end of the rectangular tube 32, such mounting plate 5 providing an additional contact and support surface for a bolted attachment to the under surface of the bench top 2.

Figure 2:
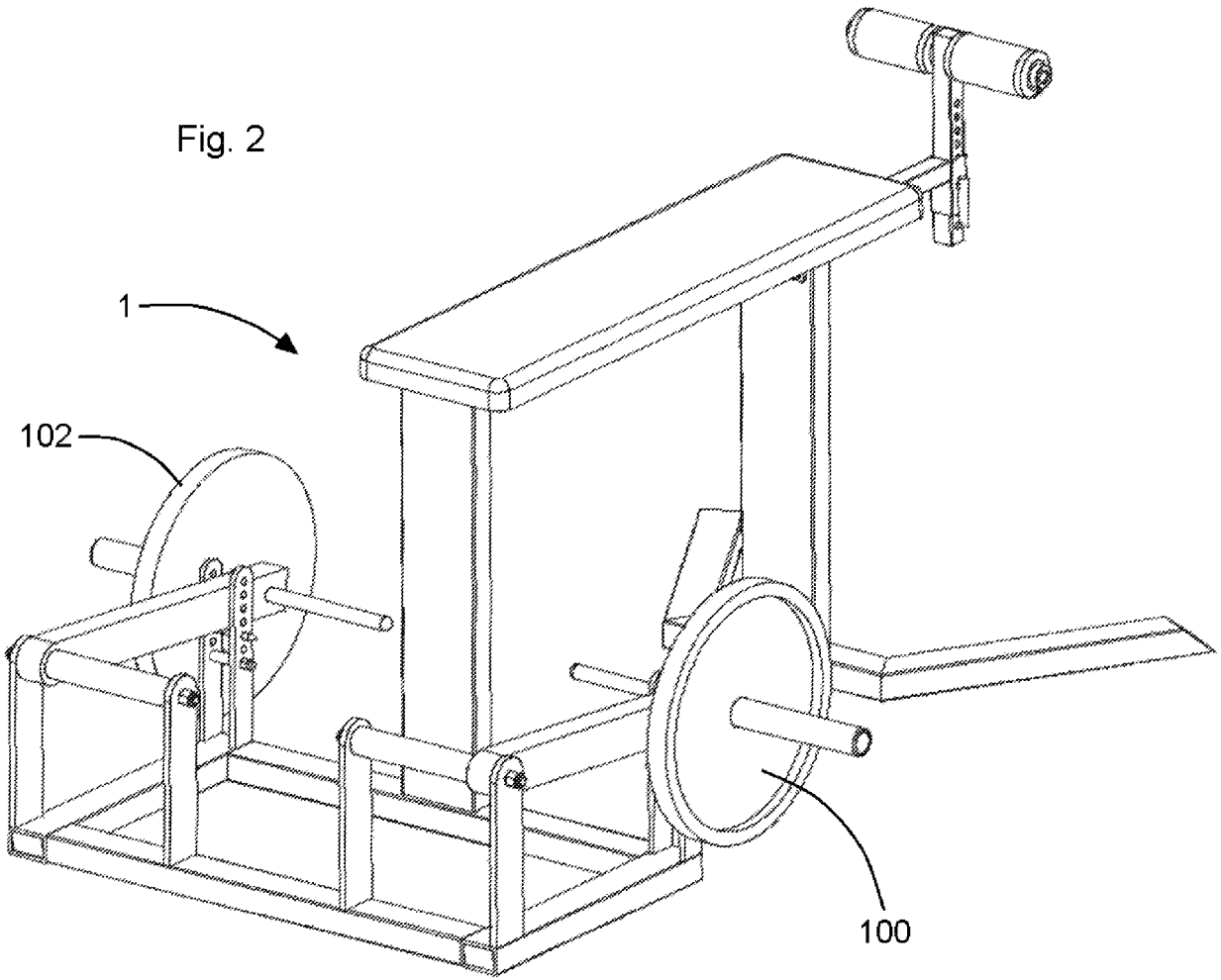
FIG. 2 redepicts FIG. 1, the view of FIG. 2 additionally showing free weights installed upon the machine.

Referring further to FIGS. 1 and 2, in order to provide enhanced lateral stability to the exercise machine 1, a "T" beam is preferably fixedly welded to the extreme lower end of the rectangular tube 32, such "T" beam 34 preferably having fixedly welded to its distal ends left and right longitudinal stabilizing members 36 and 38.

Referring further simultaneously to FIGS. 1 and 3, a further structural component of the instant inventive exercise machine 1 comprises a "J" leg which is referred to generally by Reference Arrow 40. The "J" leg 40 preferably comprises a stem section which preferably constitutes a vertically extending length of steel rectangular tubing 42, such tube 42 preferably matching the length and dimensions of the rear rectangular tube 32. The front mounting plate 6 of the longitudinal support beam 4 is preferably fixedly bolted to the rearward face of the rectangular tube 42 and, similarly with the upper end of rectangular tube 32, a laterally extending mounting plate 3 serves to rigidly interconnect and support the forward end of the bench top 2.

Referring further simultaneously to FIGS. 1 and 3, the lower end of the "J" leg's stem section preferably comprises a laterally extending stabilizer beam 44, such beam 44 extending leftwardly and rightwardly from the lower end of the rectangular tube 42. The juncture between the lower end of the rectangular tube 42 and the stabilizer beam 44 may be either a fixedly welded joint or a bolted disassembleable connection.

Referring further simultaneously to FIGS. 1 and 3, the "J" leg 40 preferably further comprises a forwardly extending tail section which preferably comprises left and right longitudinally extending stabilizer bars 46 and 48, a transverse bar 50 spanning between and interconnecting the forward ends of bars 46 and 48. A plurality of pivot mount support columns 52, 54, 56, and 58 preferably complete the "J" leg's tail section, the upper ends of such columns constituting a distal end of the tail section. As can best be seen in the side elevation of FIG. 3, the rectangular tube 42, in combination with beams 46 and 48, and support columns 52-58, form the figure "J" character of the invention's forward leg.

Referring further simultaneously to FIGS. 1 and 3, a further structural component of the instant inventive exercise machine comprises at least a first pivot arm 88, and preferably first and second, or right or left, pivot arms 88 and 90. Pivotal mounting means, preferably in the form of laterally elongated axle sleeves 92 and 94 respectively receiving axle pins 96 and 98, serve to pivotally interconnect the proximal ends of the pivot arms 88 and 90 with the upper ends of the pivot support mounts 52-58. Inwardly extending pull handles 84 and 86 are preferably fixedly welded to the distal ends of the pivot arms 88 and 90, and free weight support bars 80 and 82 are preferably similarly fixedly welded to such distal ends.

Referring simultaneously to all figures, in use of the instant inventive machine 1, an exerciser may initially slidably mount free weights 100 and 102 respectively over the free weight bars 80 and 82. Thereafter, the exerciser may lie face down upon the bench top 2 with head forward, and may thereafter extend his or her left and right arms downwardly to grasp in his or her left and right arms the handles 84 and 86. Substantially simultaneously, the exerciser may engage his or her left and right heels with left and right heel catch cushions 26 and 28. Thereafter, the exerciser may reciprocatingly raise and lower handles 84 and 86 against the resistance to pivoting provided by free weights 100 and 102, such reciprocating action effectively exercising the exerciser's deltoid, trapezius, teres major shoulder and back muscles, and brachialls, biceps brachii, and brachiordialis arm muscles.

Referring further simultaneously to all figures, it is preferable that, upon a release by the exerciser of handles 84 and 86, free weights 100 and 102 not strike against the floor surface 104. Additionally, it is preferred that when the free weights 100 and 102 pivotally move to their lowest positions, the handles 84 and 86 underlie the bench top a distance no greater than that which may be accommodated by the arm length of the exerciser. In order to accommodate such desirable functions, pivot stopping means are preferably provided, such means preferably comprising left and right upwardly opening "U" brackets which are referred to generally by Reference Arrows 63 and 65. "U" bracket 63 preferably comprises left and right arm catching fingers 60 and 62, and the right "U" bracket 65 preferably similarly comprises left and right arm catching fingers 64 and 66. Laterally aligned series of adjustment apertures 72 preferably extend laterally through fingers 60 and 62 aperture series 76 preferably similarly extend laterally through fingers 64 and 66. Removable "L" pins 74 and 78 preferably extend slidably through apertures 72 and 76 to form adjustable floors or base supports of the "U" brackets 63 and 65, while rigidly installed cross-bracing bolts 68 and 70 provide for structural rigidity of the "U" brackets 63 and 65. Through adjustable vertical positioning of "L" pins 74 and 78 within adjustment apertures 72 and 76, the elevations at which downward pivoting motions of the pivot arms 88 and 90 are stopped may be conveniently selectively adjusted in accordance with the arm length of a particular exerciser utilizing the machine 1.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An rowing motion exercise machine comprising:

(a) a substantially horizontal bench top having a right side, a left side, a forward end, a rearward end, and having an upper support surface;

(b) a rear leg fixedly attached to and extending downwardly from the bench top's rearward end;

(c) a "J" leg having a stem section and a tail section, the "J" leg's stem section having an upper end fixedly attached to the bench top's forward end, the "J" leg's tail section having a distal end, the upper end of the "J" leg's stem section extending above the distal end of the "J" leg's tail section;

(d) at least a first arm, the at least first arm having a proximal end and a distal end, the proximal end of the at least first arm being pivotally attached to the distal end of the "J" leg's tail section;

(e) a first handle fixedly attached to the at least first arm's distal end, the pivotal attachment of the proximal end of the at least first arm facilitating reciprocating upward and downward motions of the first handle below the substantially horizontal bench top; and (f) pivot resisting means connected operatively to the at least first arm; the pivot resisting means comprising a free weight bar, the free weight bar being fixedly attached to the at least first arm's distal end.

2. The exercise machine of claim 1 further comprising a second arm having a proximal end, and having a distal end, the second arm's proximal end being pivotally attached to the distal end of the "J" leg's tail section; a second handle fixedly attached to the second arm's distal end; and a second free weight bar fixedly attached to the second arm's distal end.

3. The exercise machine of claim 2 wherein the "J" leg's tail section comprises right and left extensions, the pivotal attachments of the at least first and second arms' proximal ends being respectively positioned at said right and left extensions.

4. The exercise machine of claim 3 further comprising right and left pivot stopping means respectively fixedly attached to the right and left extensions of the "J" leg's tail section, the pivot stopping means being adapted for resisting downward pivoting movements of the at least first and second arms, and for permitting upward pivoting movements of said arms.

5. The exercise machine of claim 4 wherein the right and left pivot stopping means respectively comprise right and left "U" brackets.

6. The exercise machine of claim 5 wherein each bracket among the right and left "U" brackets comprises right and left fingers, and further comprises a height adjustable base spanning between the right and left fingers.

7. The exercise machine of claim 6 wherein each height adjustable base among the right and left "U" brackets' height adjustable bases comprises a slide pin.

8. The exercise machine of claim 7 further comprising a heel catch and adjustable attaching means interconnecting the heel catch and the bench top's rearward end.

9. The exercise machine of claim 8 wherein the adjustable attaching means comprises at least a first quill and shaft combination.

* * * * *